US009708892B2

(12) United States Patent
Langlais

(10) Patent No.: US 9,708,892 B2
(45) Date of Patent: Jul. 18, 2017

(54) GRAVEL PACKING SCREEN JOINTS

(71) Applicant: SCHLUMBERGER TECHNOLOGY CORPORATION, Sugar Land, TX (US)

(72) Inventor: Michael Langlais, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 609 days.

(21) Appl. No.: 14/169,431

(22) Filed: Jan. 31, 2014

(65) Prior Publication Data

US 2015/0218915 A1 Aug. 6, 2015

(51) Int. Cl.
*E21B 43/04* (2006.01)

(52) U.S. Cl.
CPC ..... *E21B 43/04* (2013.01)

(58) Field of Classification Search
CPC ..... E21B 43/04
See application file for complete search history.

(56) References Cited

U.S. PATENT DOCUMENTS

| | | | | |
|---|---|---|---|---|
| 5,390,966 | A | 2/1995 | Cox et al. | |
| 5,868,200 | A | 2/1999 | Bryant et al. | |
| 6,752,207 | B2 | 6/2004 | Danos et al. | |
| 7,055,609 | B2 | 6/2006 | Hayes et al. | |
| 7,493,959 | B2 | 2/2009 | Johnson et al. | |
| 7,866,708 | B2 | 1/2011 | Johnson et al. | |
| 7,938,184 | B2 | 5/2011 | Yeh et al. | |
| 8,839,861 | B2 * | 9/2014 | Yeh | E21B 43/04 166/278 |
| 2002/0074641 | A1 | 6/2002 | Towle et al. | |
| 2002/0174984 | A1 | 11/2002 | Jones et al. | |
| 2002/0189808 | A1 | 12/2002 | Nguyen et al. | |
| 2002/0195253 | A1 | 12/2002 | Hill, Jr. et al. | |
| 2005/0082060 | A1 | 4/2005 | Ward et al. | |
| 2014/0262208 | A1 * | 9/2014 | Cunningham | E21B 43/04 166/115 |

OTHER PUBLICATIONS

PCT/US2014/066817, International Search Report and Written Opinion, dated Feb. 26, 2015, 13 pgs.

* cited by examiner

*Primary Examiner* — Brad Harcourt
(74) *Attorney, Agent, or Firm* — Jeffery R. Peterson

(57) ABSTRACT

A technique facilitates formation of a gravel pack. Gravel slurry is delivered downhole at least in part along a transport conduit from one screen joint to the next. Downstream of a joint connection between two adjacent screen joints, gravel slurry from the transport conduit flows into a gravel slurry chamber. From the gravel slurry chamber, the gravel slurry flows into at least one packing conduit or into at least one packing conduit and at least one transport conduit. The packing conduits are used to discharge the gravel slurry for formation of a gravel pack in a wellbore annulus surrounding the gravel packing system, and the transport conduits are used to deliver the gravel slurry to downstream screen joints for discharge at a more distant location along the wellbore.

17 Claims, 4 Drawing Sheets

GRAVEL PACKING SCREEN JOINTS

BACKGROUND

Gravel packs are used in wells for removing particulates from inflowing hydrocarbon fluids. In a variety of applications gravel packing is performed in long horizontal wells by pumping gravel suspended in a carrier fluid down the annulus between the wellbore and a screen assembly. The carrier fluid is returned to the surface after depositing the gravel in the wellbore annulus. To return to the surface, the carrier fluid flows through the screen assembly, through base pipe perforations, into a base pipe, and into production tubing which routes the returning carrier fluid back to the surface. In some applications, the gravel packing system comprises alternate path screen technology in which alternate path tubes are located external to the base pipe. The alternate path tubes are used to facilitate delivery of the gravel slurry. However, connecting alternate path transport tubes and packing tubes across joint connections while achieving a pressure bearing seal presents a variety of challenges.

SUMMARY

In general, a system and methodology are provided for facilitating formation of a gravel pack. Gravel slurry is delivered downhole at least in part along a transport conduit from one screen joint to the next. Downstream of a joint connection between two adjacent screen joints, gravel slurry from the transport conduit flows into a gravel slurry chamber. From the gravel slurry chamber, the gravel slurry flows into at least one packing conduit or into at least one packing conduit and at least one transport conduit. The packing conduits are used to discharge the gravel slurry for formation of a gravel pack in a wellbore annulus surrounding the gravel packing system, and the transport conduits are used to deliver the gravel slurry to downstream screen joints for discharge at a more distant location along the wellbore.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate formation of gravel packs in wellbores. Gravel slurry is delivered downhole at least in part along conduits from one screen joint to the next of a tubing string deployed in a gravel packing system. The conduit or conduits of each screen joint may be located externally of a base pipe of the screen joint. The connection of conduits from one screen joint to the next creates a continuity of one or more flow paths external to the base pipe while achieving a pressure bearing seal across the junctions between screen joints. In various embodiments, the connection system employed to connect adjacent screen joints is designed to couple the base pipes and the conduits of the adjacent screen joints with a single action of threading the adjacent screen joints together. In, for example, open hole applications, the gravel packing system enables the connection of screen joints in open hole alternate path screen products via the single action of threading adjacent screen joints together.

In embodiments described herein, the gravel packing system is designed so that gravel slurry flows through the conduit past a joint connection between two adjacent screen joints and into a downstream gravel slurry chamber separated from the screen joint connection. From the gravel slurry chamber, the gravel slurry flows into at least one packing conduit or into at least one packing conduit and at least one transport conduit. The packing conduits are used to discharge the gravel slurry for formation of a gravel pack in a wellbore annulus surrounding the gravel packing system. The transport conduits are used to deliver the gravel slurry to downstream screen joints for discharge at a more distant location along the wellbore.

Figure 1:
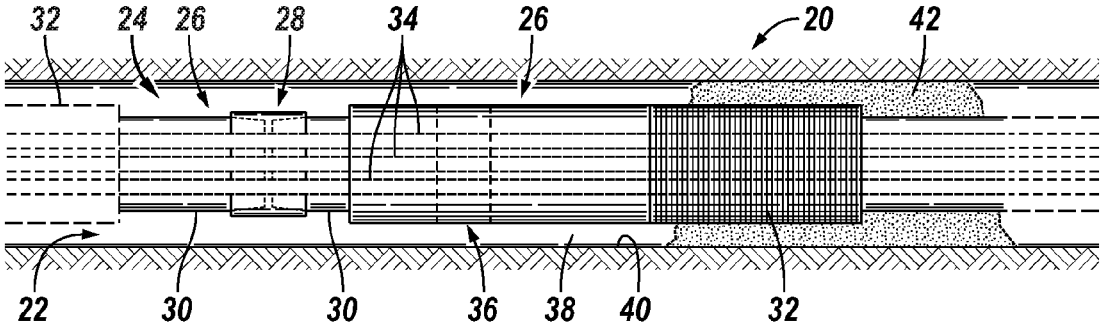
FIG. 1 is a schematic illustration of an example of a gravel packing system deployed in a wellbore, according to an embodiment of the disclosure.

Referring generally to FIG. 1, an example of a well system 20 deployed in a wellbore 22 is illustrated. In this example, well system 20 comprises a gravel packing system 24 having a plurality of screen joints 26 coupled together sequentially to form a completion tubing string. Adjacent pairs of screen joints 26 are coupled together at a screen joint connection 28, and the number of screen joints 26 and screen joint connections 28 may vary depending on the gravel packing application. Each screen joint 26 also may comprise a base pipe 30 combined with, for example, a screen 32 surrounding the base pipe 30. At least one conduit 34 extends along the screen 32 externally of the base pipe 30. The at least one conduit 34 is used to deliver gravel slurry.

Each screen joint connection 28 couples the base pipe 30 and the at least one conduit 34 of a first screen joint 26 to a second screen joint 26 of a pair of adjacent screen joints. In this example, the second or downstream screen joint 26 also comprises a gravel slurry chamber 36 disposed externally of the base pipe 30 and downstream of the screen joint connection 28. It should be noted that "downstream" is used herein to refer to a downstream position with respect to flow of gravel slurry as the gravel slurry travels downhole into wellbore 22. In some applications, the chamber 36 may be an annular chamber extending partially or fully around the circumference of the base pipe 30. The chamber 36 receives gravel slurry from the at least one conduit 34 associated with the screen joint 26 carrying the chamber 36 and distributes the gravel slurry to a plurality of downstream conduits 34 extending farther down along the second screen joint.

In some applications, gravel slurry flows through conduits 34 in the form of at least one transport conduit, e.g. transport tube. The transport conduit(s) carries the gravel slurry across the screen joint connection 28 and into chamber 36 of the next adjacent or second screen joint 26. From chamber 36, the gravel slurry may be distributed into at least one conduit 34 in the form of at least one packing conduit, e.g. packing tube, for distribution into an annular region 38 between the gravel packing system 24 and a surrounding wellbore wall 40 of the wellbore 22. The gravel slurry is then dehydrated to form a gravel pack 42 or at least a portion of the overall gravel pack 42 in the annular region 38. If the gravel packing system 24 comprises additional downstream screen joints 26, the gravel slurry may be routed from chamber 36 into downstream conduits 34 comprising at least one transport conduit for delivering gravel slurry to the next sequential screen joint 26 and at least one packing conduit for distributing a portion of the gravel slurry into the surrounding wellbore annulus for creation of gravel pack 42.

Figure 2:
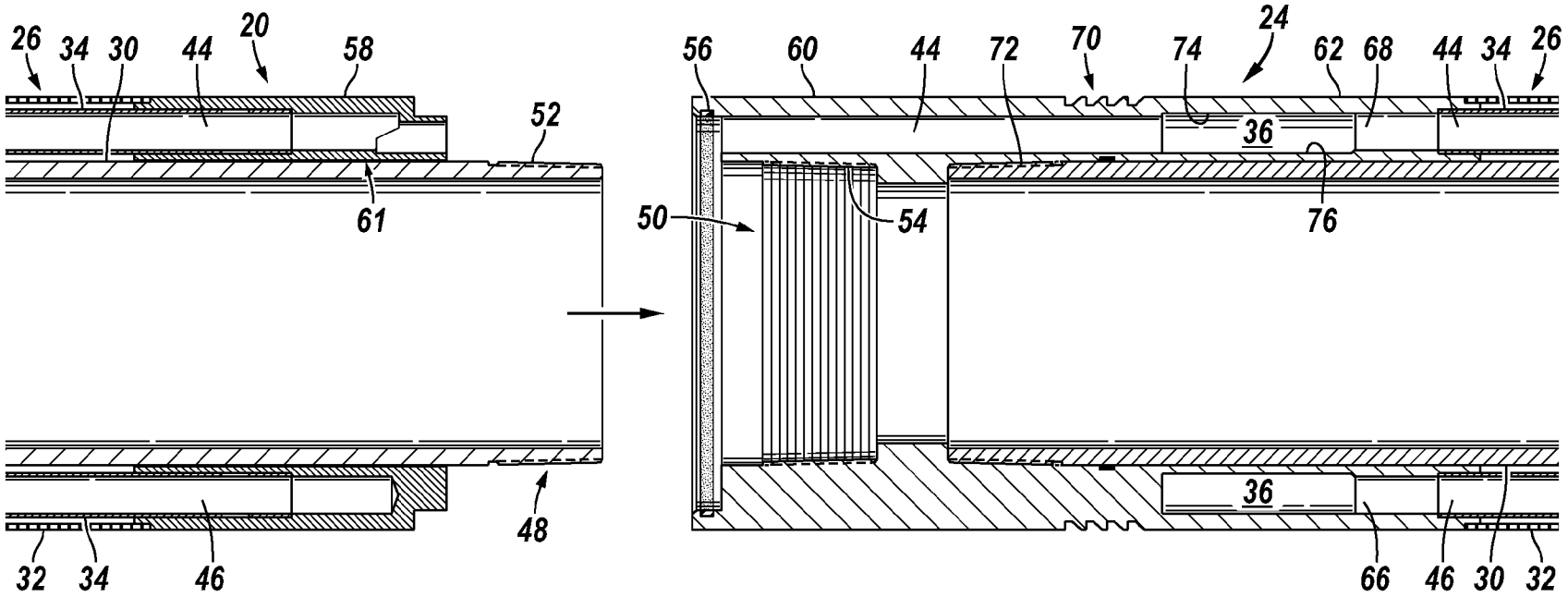
FIG. 2 is a cross-sectional view of an example of a pair of sequential screen joints to be joined at a screen joint connection, according to an embodiment of the disclosure.

In FIG. 2, an example of adjacent screen joints 26 of gravel packing system 24 is illustrated with the adjacent screen joints 26 uncoupled at screen joint connection 28. In this embodiment, a first or upstream screen joint 26 is positioned for engagement with a second or next adjacent downstream screen joint 26. Each illustrated screen joint 26 comprises screen 32 surrounding a corresponding base pipe 30. Additionally, each illustrated screen joint 26 comprises a plurality of conduits 34, such as at least one transport conduit 44 and at least one packing conduit 46. The conduits 34 may be routed along the corresponding screen joint 26 between the base pipe 30 and the screen 32, but some applications may route the conduits 34 in whole or in part along an exterior of screen 32.

Figure 3:
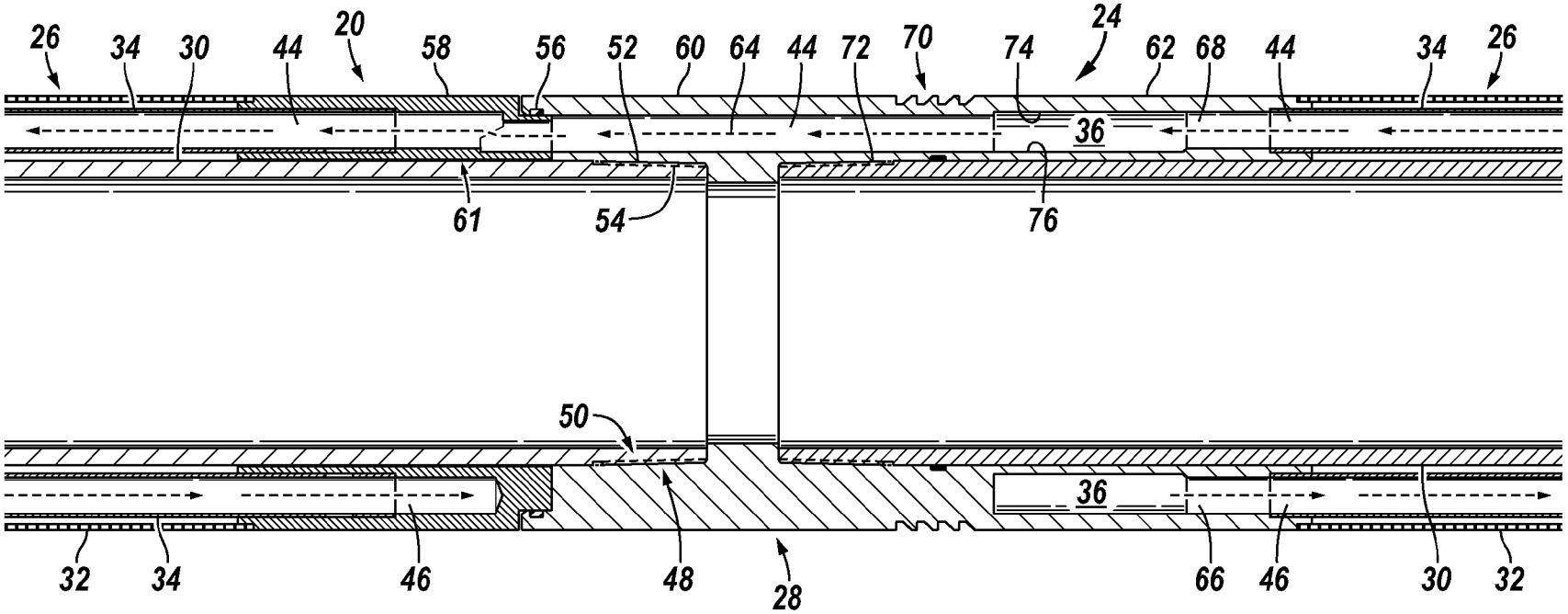
FIG. 3 is a cross-sectional view similar to that of FIG. 2 but showing the adjacent screen joints in an engaged configuration, according to an embodiment of the disclosure.

In the embodiment illustrated in FIG. 2, screen joint connection 28 is constructed to enable a single action make-up of two screen joints 26. The screen joint connection 28 also connects and independently seals both the base pipes 30 and the transport conduits 44 of the two joined, adjacent screen joints 26. By way of example, the screen joint connection 28 may include a male base pipe connector 48 and a corresponding female base pipe connector 50 which may be coupled together via, for example, rotation of one screen joint 26 with respect to the adjacent screen joint 26 to connect the pair of adjacent screen joints 26, as illustrated in FIG. 3. Examples of connectors 48, 50 and screen joint connection 28 comprise a "timed" make-up connector (e.g. connectors available from the Hunting PLC company), an "oriented" make-up connector (e.g. connectors available from the VAM USA company), or another suitable connector. In some applications, the connectors 48, 50 are equipped with corresponding timed pin threads 52 and timed box threads 54, respectively. The various connectors 48, 50 establish alignment of transport conduits between the first screen joint 26 and the adjacent second screen joint 26 to enable flow of gravel slurry from the first to the second screen joint 26.

The connectors 48, 50 are constructed to provide a seal between the joined base pipes 30. A separate seal 56, such as a radial seal or a face seal, may be located externally of the transport conduits 44 to provide a seal between joined transport conduits 44 of sequential screen joints 26. In some applications, formation of the screen joint connection 28 may be facilitated by mounting a torque housing 58 about the base pipe 30 of one of the screen joints 26 and a corresponding connection housing 60 about the base pipe 30 of the next adjacent, second screen joint 26. For a series of screen joints 26, at least some of the screen joints 26 may have torque housing 58 and connection housing 60 located on opposed ends of the screen joint. By way of example, the seal 56 may be mounted on the torque housing 58 and/or connection housing 60 or otherwise positioned between the torque housing 58 and connection housing 60 to form a seal about the transport conduits 44.

In FIGS. 2 and 3, the torque housing 58 is illustrated as mounted on the downhole end of the first screen joint 26 and connection housing 60 is illustrated as mounted on the uphole end of the second screen joint 26. However, the torque housing 58 and connection housing 60 can be reversed and mounted on the uphole end and downhole end, respectively, of the corresponding screen joints 26. Various additional seals also may be used along torque housing 58 and/or connection housing 60. An example is a seal 61, e.g. an O-ring seal, positioned internally between torque housing 58 and the base pipe 30.

A first portion of the transport conduit(s) 44 of the downstream, second screen joint 26 carries the gravel slurry from the screen joint connection 28 and into chamber 36. In this embodiment, chamber 36 is illustrated as an annular chamber disposed in a manifold portion 62 of the corresponding screen joint 26. As briefly described above, the gravel slurry flows along the at least one transport conduit 44 of the first screen joint 26 and is directed across the screen joint 28 via the aligned transport conduits 44, as indicated by dashed line 64. The gravel slurry then enters the first portion of transport conduit(s) 44 along the second screen joint 26 and flows into chamber 36 where the gravel slurry is free to move circumferentially around at least a portion of the base pipe 30.

From the chamber 36, the gravel slurry flows through at least one packing conduit entry port 66 and then into the corresponding packing conduit or conduits 46. Sometimes, the second screen joint includes at least one downstream transport conduit 44 intersecting the chamber 36 via at least one corresponding transport conduit entry port 68. The downstream transport conduit allows a portion of the gravel slurry to flow from chamber 36, along the downstream transport conduit 44, and to a next sequential screen joint 26. The coupled transport conduits 44 carry a portion of the gravel slurry longitudinally along sequential screen joints 26 to the last screen 32 at the downstream end of the gravel packing system 24. The packing conduit(s) 46 carries the gravel slurry longitudinally along the corresponding screen joint 26 while depositing the gravel slurry into the annular region 38 surrounding that screen joint 26. The gravel slurry may be discharged from the at least one packing conduit 46 through, for example, intermittently spaced nozzles or other suitable devices. In this example, the packing conduit(s) 46 terminates at the end of each corresponding screen joint and thus does not continue across the subsequent screen joint connection 28.

Construction of the various screen joint components may vary from one application to another. For example, the chamber 36 may be annular in the sense that it extends partially or fully around the base pipe 30. In some applications, the torque housing 58 and connection housing 60 may have additional features, such as a plurality of load bearing grooves 70 which facilitate gripping, handling and/or hanging of the screen joints 26 from the rig floor. Additionally, the torque housing 58 and connection housing 60 may have a variety of configurations. For example, the connection housing 60 may be constructed to include the uphole portion of the transport conduit or conduits 44 which extend from the screen joint connection 28 to the chamber 36, the chamber 36 being located downstream from the screen joint connection. In some embodiments, the connection housing 60 also may serve to couple the base pipe 30 with the connector 50 of the screen joint 26, e.g. of the downstream, second screen joint. In this latter example, the connection housing 60 may be joined with the corresponding base pipe 30 and/or connector 50 via timed connection threads 72 or other suitable connection techniques.

Figure 4:
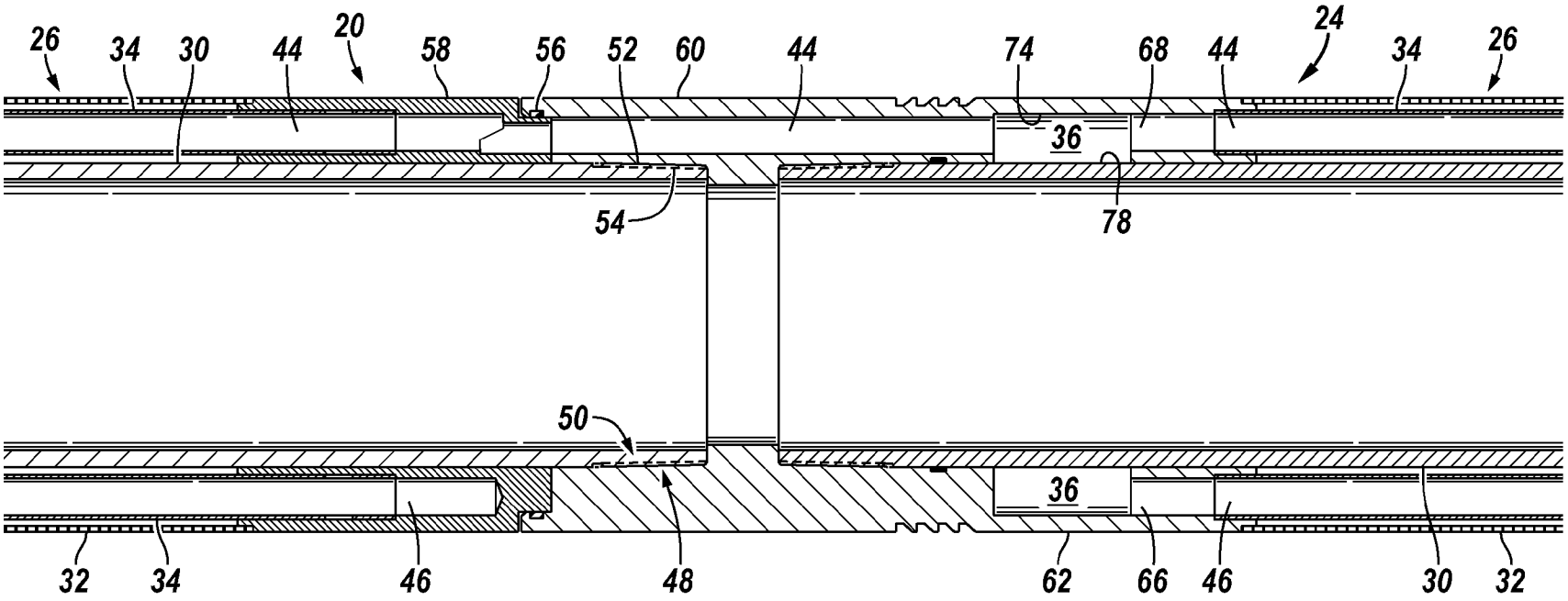
FIG. 4 is a cross-sectional view of another example of a pair of sequential screen joints joined at a screen joint connection, according to an embodiment of the disclosure.

Similarly, the manifold 62 may have a variety of constructions which, for example, establish chamber 36 as a sealed chamber with respect to the flow of gravel slurry therethrough. In this embodiment, the sealed chamber 36 is confined externally by an outer manifold wall 74 and internally by an internal manifold wall 76, as illustrated in FIG. 3, or by an exterior surface 78 of the base pipe 30, as illustrated in the embodiment of FIG. 4. In the embodiments illustrated, the manifold 62 also may be used to form a portion of the downstream packing conduits 46 and/or transport conduits 44. In this type of embodiment, the flowing gravel slurry flows from chamber 36 and enters into the packing and/or transport conduits defined by the downstream side of manifold 62. In some embodiments, the chamber 36 may be completely open to circumferential flow and in other embodiments, the chamber 36 may be established by a solid body manifold 62 having conduits or ports which cross communicate the transport conduits 44 and packing conduits 46. Depending on the application, the manifold 62 may have a variety of configurations which cooperate with the corresponding base pipe 30 and conduits 34 of the screen joint 26.

Additionally, a variety of seals 56, 61 may be employed to provide the desired sealing across screen joint connection 28. For example, the transport conduits 44 may be sealed at screen joint connection 28 via seal 56 in the form of a radial seal, e.g. a male or female gland seal. In this example, the transport conduits are collectively contained by a common seal barrier which places the plurality of transport conduits 44 at the same pressure. A similar containment seal 56 may be in the form of a face seal positioned externally of the transport conduits 44. In another embodiment, the sealing of the transport conduits 44 at each screen joint connection 28 may be formed with multiple seals 56. Multiple seals 56 can be used to provide independent pressure containment for each transport conduit 44 or for specific groups of transport conduits 44. Such selective sealing may be achieved by employing seal 56 in the form of a face seal which encircles the individual transport conduit 44 or the selected group of transport conduits 44 which is to be isolated from the other transport conduits 44. By way of example, seal 56 may be in the form of a face seal positioned on the face of either the torque housing 58 or the connection housing 60. During make-up of the two adjacent screen joints 26 to create screen joint connection 28, the face seal 56 compresses against the face of the opposing torque housing 58/connection housing 60 to form the desired seal with respect to transport conduits 44.

In the embodiments described herein, chamber 36 is positioned downstream of the screen joint connection 28 so the pressure containment associated with chamber 36 is moved away from the screen joint connection. Additionally, the downstream positioning of chamber 36 enables sealing off of chamber 36 through a variety of techniques not available for use at the screen joint connection 28. For example, welds may be used between components creating chamber 36 (e.g. an outer chamber wall can be welded to the manifold 62 on one end and to the connection housing 60 on the other end) to create a secure seal of chamber 36 even when deforming pressures are applied.

In the examples illustrated herein, various configurations of screen joints may be assembled to create gravel packing systems for use in many types of wellbores, including deviated, e.g. horizontal, wellbores. Additionally, the number of screen joints and the overall length of the gravel packing system may vary depending on the specifics of a given gravel packing operation. The screen joints also may be combined with many other types of gravel packing related components, including valves, sliding sleeves, inflow control devices, carrier fluid return tubes, packers, and other components used to facilitate and control the gravel packing operation.

Furthermore, the screen joints may be constructed in various configurations with a number of different components. Certain embodiments of screen joints may comprise screens of many types of materials formed as meshes, perforated layers, or other suitable configurations for restricting the inflow of particulates. The conduits, e.g. transport conduits and perforating conduits, may have various shapes, sizes and lengths to accommodate a given gravel packing operation. The screen joint connections also may utilize many types of configurations, seals, engagement features, e.g. timed threads, and/or other components which secure the engagement of sequential screen joints. Each screen joint may comprise the described torque housing and connection housing on opposing ends. Other types of housings also may be constructed to facilitate connection of screen joints, alignment of transport conduits, and sealing of the joint to accommodate flow through both the base pipe and the transport conduits as in the embodiments described above.

Similarly, the chamber located downstream of the screen joint connection may have various constructions which enable commingling of gravel slurry received from a plurality of transport conduits. The chamber may have a variety of sizes and configurations, including annular configurations which extend partially or fully about the base pipe. Additionally, the chamber may be sealed off from an interior of the base pipe and from an exterior annulus to accommodate the isolated flow of gravel slurry from upstream transport conduits to downstream packing conduits and/or transport conduits. For example, the chamber may be sealed off with a variety of elastomeric seals and/or welded connections to ensure the desired isolation of the chamber.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a gravel packing system deployed in a wellbore and comprising:

a pair of screen joints coupled at a screen joint connection, each screen joint comprising a base pipe, a screen surrounding the base pipe, and a conduit extending along the screen externally of the base pipe to deliver a gravel slurry, the screen joint connection coupling the base pipe and the conduit from a first screen joint to a second screen joint of the pair of screen joints;

the second screen joint having an annular chamber disposed externally of the base pipe and downstream of the screen joint connection, the annular chamber receiving gravel slurry from the conduit of the second screen joint and distributing the gravel slurry to a plurality of downstream conduits disposed along the second screen joint, wherein the screen joint connection comprises a torque housing joined with a connection housing.

2. The system as recited in claim 1, wherein the plurality of downstream conduits comprises a transport conduit and a packing conduit.

3. The system as recited in claim 1, wherein the conduit comprises a plurality of conduits on the first screen joint and a plurality of conduits on the second screen joint.

4. The system as recited in claim 1, wherein the screen joint connection couples corresponding ends of the base pipes via a timed, threaded connection.

5. The system as recited in claim 1, wherein the screen joint connection comprises at least one face seal to enable sealed joining of the conduit of the first screen joint with the conduit of the second screen joint.

6. The system as recited in claim 1, wherein each screen joint comprises at least one packing conduit.

7. The system as recited in claim 1, wherein the annular chamber is isolated in a manifold of the second screen joint between an outer manifold wall and an inner manifold wall.

8. The system as recited in claim 1, wherein the annular chamber is isolated in a manifold of the second screen joint between an outer manifold wall and an exterior surface of the base pipe.

9. The system as recited in claim 1, wherein the first screen joint comprises a first screen joint annular chamber for receiving gravel slurry from an upstream screen joint.

10. A method for delivering gravel slurry in a well, comprising:

delivering a gravel slurry along a transport conduit of a first screen joint external to a base pipe of the first screen joint;

directing the gravel slurry past a screen joint connection formed between the first screen joint and a second screen joint located downstream of the first screen joint;

discharging the gravel slurry into a chamber of the second screen joint, the chamber being located downstream of the screen joint connection and externally of a second base pipe of the second screen joint, enclosing the chamber between a manifold outer wall and a manifold inner wall of a manifold of the second screen joint;

routing the gravel slurry from the chamber into a packing conduit of the second screen joint; and injecting the gravel slurry from the packing conduit and into a desired wellbore region surrounding the second screen joint.

11. The method as recited in claim 10, wherein delivering comprises delivering the gravel slurry along a plurality of transport conduits.

12. The method as recited in claim 10, wherein delivering comprises delivering the gravel slurry along the transport conduit while the transport conduit is positioned radially between the base pipe and a screen or radially external to the screen.

13. The method as recited in claim 10, wherein routing comprises routing the gravel slurry into the packing conduit and into a transport conduit of the second screen joint.

14. The method as recited in claim 10, wherein discharging the gravel slurry into the chamber comprises discharging the gravel slurry into an annular chamber extending around the base pipe.

15. A system, comprising:

a gravel packing system having a plurality of screen joints coupled along a tubing string via a screen joint connection, each screen joint comprising a base pipe, at least one transport conduit, at least one packing conduit, and a gravel slurry chamber disposed separately from the screen joint connection, the gravel slurry chamber having an upstream portion to receive a gravel slurry from an upstream section of the at least one transport conduit and a downstream portion to discharge the gravel slurry into a downstream portion of the at least one transport conduit and into the packing conduit, the chamber being between enclosed between a manifold outer wall and an exterior surface of the base pipe of the second screen joint.

16. The system as recited in claim 15, wherein each gravel slurry chamber comprises an annular chamber disposed about the base pipe.

17. The system as recited in claim 15, wherein each screen joint further comprises a screen and a separate gravel slurry chamber is disposed on each consecutive screen joint.

* * * * *